United States Patent [19]

Kataoka

[11] Patent Number: 4,951,597

[45] Date of Patent: Aug. 28, 1990

[54] SOLDER COATING DEVICE WITH OXIDE COLLECTING TROUGH

[75] Inventor: Shigeaki Kataoka, Shizuko Prefecture, Japan

[73] Assignee: Fuji Seiki Machine Works, Ltd., Shizuko Prefecture, Japan

[21] Appl. No.: 410,613

[22] Filed: Sep. 21, 1989

[30] Foreign Application Priority Data

Sep. 29, 1988 [JP] Japan ..... 63-242356

[51] Int. Cl.[5] ..... B05C 1/02

[52] U.S. Cl. ..... 118/58; 118/74; 118/227; 118/253; 118/258; 228/34; 228/38; 228/43

[58] Field of Search ..... 118/58, 74, 220, 221, 118/222, 227, 206, 224, 209, 244, 253, 258, 225; 228/34, 38, 43

[56] References Cited

U.S. PATENT DOCUMENTS

| | | | |
|---|---|---|---|
| 1,302,106 | 4/1919 | Watkins | 118/227 |
| 1,707,611 | 4/1929 | Hamburger et al. | 118/227 |
| 1,788,610 | 1/1931 | Ashworth et al. | 118/227 |
| 3,006,318 | 10/1961 | Monroe et al. | 118/227 |
| 3,958,039 | 5/1976 | Yabuki et al. | 118/227 |
| 4,563,974 | 1/1986 | Price | 118/304 |
| 4,741,474 | 5/1988 | Potet et al. | 228/43 |
| 4,799,450 | 1/1989 | Cornellier | 118/74 |

*Primary Examiner*—Willard Hoag

*Attorney, Agent, or Firm*—Flynn, Thiel, Boutell & Tanis

[57] ABSTRACT

A roller-type solder coating device for applying a coating of liquid solder to a workpiece. The device has a solder bath tank, a coating roller, and a nozzle connected to a pumping chamber provided in the tank to provide a flow of the solder bath to the coating roller. A trough is positioned underneath the coating roller and similarly connected to the nozzle so as to prevent direct re-entry of the solder delivered from the nozzle into the solder bath. The tank may be sealed and inert gas introduced therein to prevent oxidation of the solder contained within the tank. A second coating roller may be provided so as to permit simultaneous coating of opposite sides of a workpiece during its passage between the coating rollers.

9 Claims, 3 Drawing Sheets

SOLDER COATING DEVICE WITH OXIDE COLLECTING TROUGH

FIELD OF THE INVENTION

This invention relates to a solder coating device and, more particularly, to a roller-type solder coating device having a trough positioned in a solder bath tank to prevent direct re-entry of solder sprayed from a nozzle into the solder bath and thereby enable easy removal of solder oxides from the bath.

BACKGROUND OF THE INVENTION

Solder coating devices are known in which melted solder from a liquid solder bath is pumped to and delivered from a nozzle and coats the surface of a workpiece in the proximity of the nozzle. With this type of coating process, the molten solder is easily oxidized and presents problems when the solder oxide is returned to the solder bath. The oxidation of the solder is due to at least two factors: the sprayed solder is exposed to the atmosphere during the coating of the workpiece and the fall of solder droplets back into the solder bath, and the surface of the liquid solder bath is agitated by the returning solder droplets which aids in the oxidation of the solder bath.

To aid in the control of oxidation of the solder bath, oxidation preventive agents are generally added thereto. However, these oxidation preventive agents have problems in that they deteriorate from the heat of the solder bath over the course of time and thereby lose their effectiveness, and they tend to deposit on the surfaces of the solder coating device and thereby hinder the application of an uncontaminated coating to a workpiece. Additionally, the replenishment of used solder and oxidation preventive agents requires the shutting down of the coating device and thereby is expensive and time consuming.

On the other hand, if oxidation preventive agents are not added to the solder bath, solder oxides tend to build up around the mouth of the solder nozzle and thereby hinder the flow of solder material therefrom. Accordingly, the application of an even coating to the workpiece is made more difficult.

It is, therefore, a primary object of the present invention to provide a solder coating device which uses a spray nozzle and does not require the addition of an oxidation preventive agent.

It is a further object of the present invention to provide a solder coating device which enables the removal of solder oxides from the solder bath without the shutting down of the coating device.

It is a still further object of the present invention to reduce the formation of solder oxides in a solder bath for a solder coating device by preventing the direct re-entry of solder delivered from a nozzle into the solder bath.

It is another object of the present invention to prevent the formation of solder oxides in a solder bath used in the coating of a workpiece by a spray nozzle by conducting the coating process in an inert atmosphere.

SUMMARY OF THE INVENTION

The objects and purposes of the invention are met by providing a roller-type solder coating device having a coating roller for applying a solder coating to a surface of a workpiece, a nozzle for directing a flow of the solder bath to the coating roller, and a trough positioned under the roller and in sealing engagement with the nozzle to prevent the direct re-entry of the sprayed solder into the solder bath. An outlet for solder oxides is provided in a side of a tank containing the solder bath so as to allow the removal of solder oxides therefrom without necessitating the shutting down of the coating operation. The tank containing the solder bath can be sealed from the ambient environment and an inert gas introduced therein so as to help prevent the formation of solder oxides. A second coating roller can be provided to allow the simultaneous coating of opposed surfaces of a workpiece.

BRIEF DESCRIPTION OF THE DRAWINGS

Other objects and purposes of the invention will become apparent to those skilled in the art upon reading the following specification with reference to the accompanying drawings, in which.

DETAILED DESCRIPTION

Figure 1:
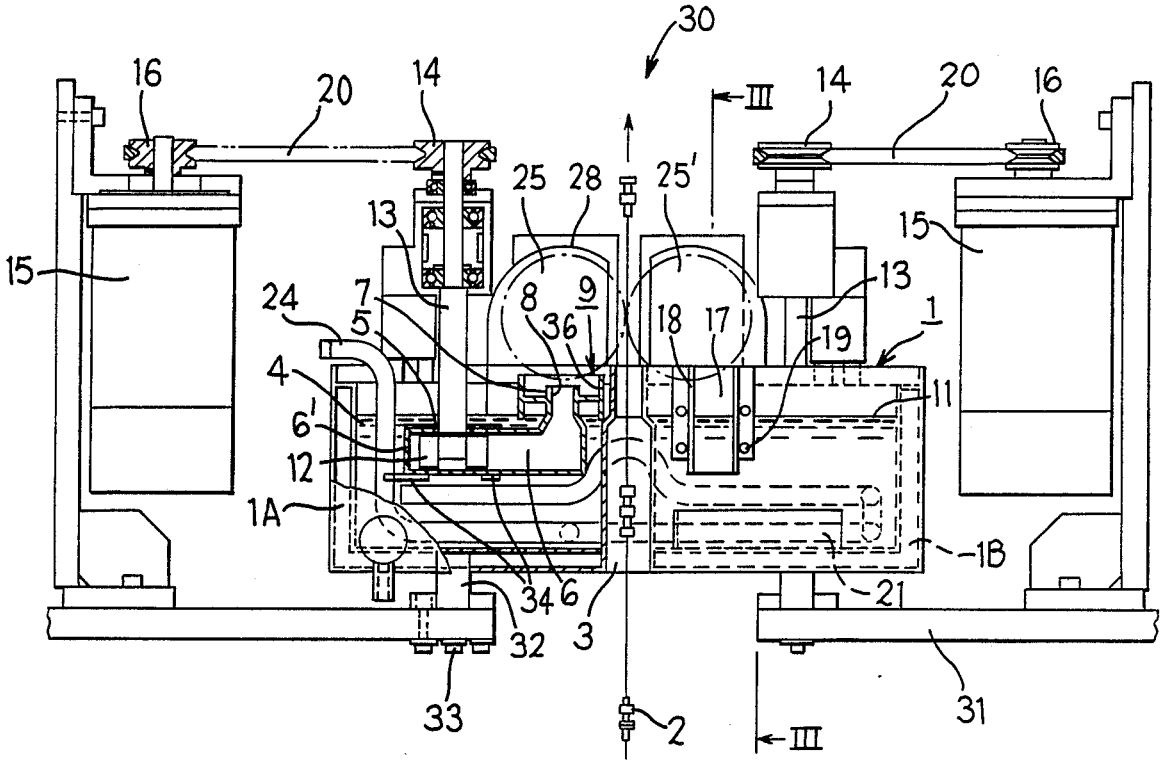
FIG. 1 is a central sectional view, in elevation, of a solder coating device according to the present invention.
Figure 2:
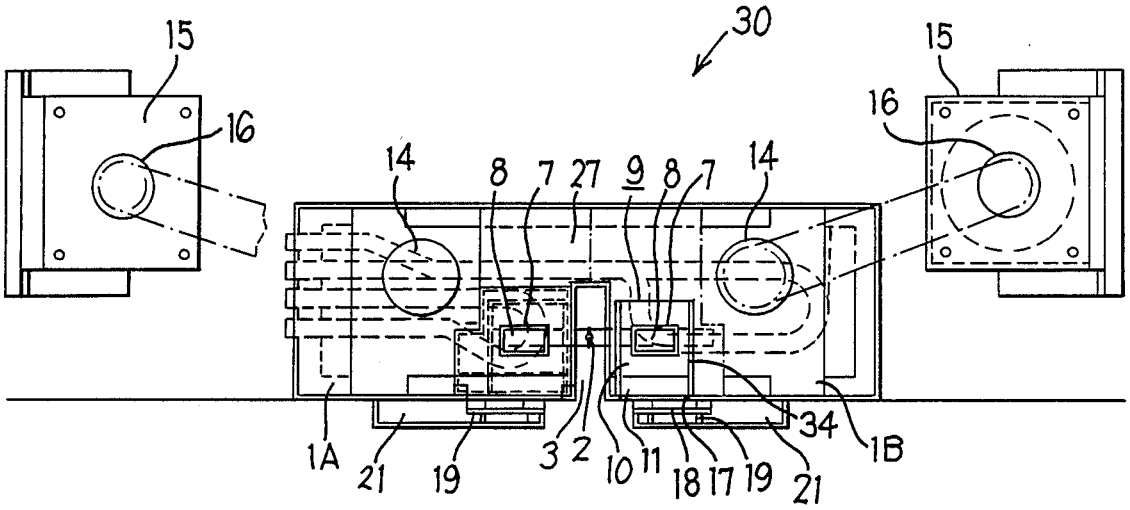
FIG. 2 is a plan view of a coating device according to the present invention.
Figure 3:
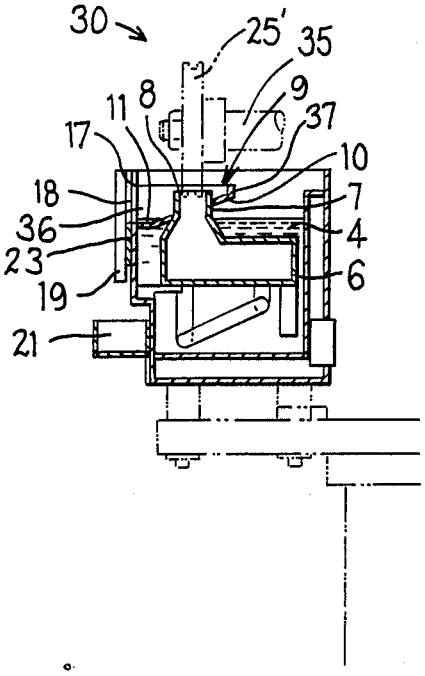
FIG. 3 is a sectional view of a coating device according to the present invention taken along line III—III of FIG. 1.

A roller-type solder coating device of the present invention is illustrated in the drawings. Referring to FIGS. 1–3, the coating device 30 comprises a tank 1 which contains a molten solder bath 4 therein. The tank 1 can be made of any material suitable for containing a molten solder bath, such as metal, and can be in any desired configuration such as square-shaped or rectangularly-shaped. The tank 1 can be mounted on a support frame 31 by the use of flanges 32 which are attached to the bottom of the tank and can be secured to the support frame by the use of bolts 33. Such an arrangement makes it possible for the coating device of the present invention to be portable and capable of movement to a desired location.

The solder bath 4 is maintained in a molten condition by heating coils 24 which are provided in the interior of the solder tank 1. Any desired heating medium, can be circulated through the heating coils in order to maintain the solder bath 4 in a molten condition.

A pumping chamber 6 is provided in the tank 1 for inducing flow through a nozzle 7, located at an upper portion of the pumping chamber 6, to create a fountain of solder for contact with a coating roller 25. The pumping chamber 6 is defined within a hollow box-like wall structure or housing 6' which is secured within the tank 1 by the use of supports 34 which are welded to the tank 1 and to the housing 6'. Inlet openings 5 are provided in an upper wall of the housing 6' in order to allow the flow of solder bath 4 into chamber 6. A pumping impeller 12 is provided in the pumping chamber 6 in order to induce the flow of solder from the pumping chamber 6 through the nozzle 7. The impeller 12 is connected to an impeller shaft 13 which is driven by a motor 15 through a pulley 16, belt 20, and pulley 14. The impeller shaft 13 may be directly driven by the motor 15 if desired.

The nozzle 7 projects upwardly from the upper wall of the pumping chamber housing 6' so as to extend slightly above the solder bath surface 11. The discharge orifice 8 of the nozzle 7 can be sized so as to deliver a desired amount of solder to the coating roller 25 at the delivery pressure produced by the impeller 12.

The coating roller 25 is positioned directly above the nozzle 7 and mounted on a shaft 35 which imparts rotational movement to the coating roller 25. The shaft 35 can be directly coupled to a motor (not shown) or driven indirectly by the use of pulleys and belts. A cover or shroud 28 is provided over the coating roller 25 and is mounted to the tank 1. A workpiece 2 passes by and contacts an outer peripheral surface of the coating roller 25 to receive a solder coating therefrom.

A trough 9 is provided under the coating roller 25 and is in sealing engagement with an outer circumferential surface of the nozzle 7 so as to be able to receive any surplus solder delivered from the nozzle 7 that is not applied to the workpiece 2. The trough 9 comprises two side walls 36, a front wall 37 and a downward sloped bottom wall 10 which opens the interior of the trough 9 to the solder bath 4. The trough 9 is located generally above the surface of the bath, but the trough has a bottom opening for controlled communication with the bath. More specifically, the side walls 36 and the bottom wall 10 project down into the bath and effectively segregate a part of the surface of the solder bath as contained within the trough 9 but allows fluid communication between the solder bath located beneath the segregated solder bath surface and the rest of the solder bath.

As shown in FIGS. 2 and 3, a solder oxide outlet opening 17 is provided in the sidewall of the solder tank 1, which outlet opening is bounded by the side walls 34 of the trough 9. The solder oxide outlet 17 is positioned so that the part of the solder bath surface 11 bounded by the trough 9 can exit therefrom.

A second solder oxide outlet 18 is provided in an inner cover or valve 23 positioned over the solder oxide outlet 17 to regulate the flow therefrom. The cover 23 can be slidingly or rotatably mounted on the tank adjacent the outlet 17, or mounted adjacent the outlet 17 by bolts. The position of the outlet 18 with respect to the outlet 17 can be adjusted by rotating or slidingly positioning the inner cover 23, or unbolting the inner cover and repositioning and rebolting the inner cover 23, such that the bottom edge of the outlet 18 is approximately at the level of the solder bath surface 11 so that the solder oxides can easily be removed therefrom. A removable outer cover 19 is attached to the inner cover 23 and is removed to allow the flow of solder oxide through the outlet 18.

A solder oxide receiving tank 21 comprising a box-like structure with an open top, a front wall, two side walls and a bottom wall is mounted on the exterior of the tank 1 and positioned directly underneath the solder oxide outlets 17 and 18 to receive any solder oxide flow therefrom.

In the preferred embodiment of the present invention as illustrated in FIGS. 1 and 2, a second coating roller 25' is provided opposite the first coating roller 25 so that a workpiece 2 passing therebetween can be simultaneously coated on opposed surfaces thereof. A workpiece passageway 3 is provided in the tank 1 so as to allow the unrestrictive movement of the workpiece 2 into contact with the coating rollers 25, 25' and unrestricted fluid communication between the solder baths 4 located beneath the rollers. As shown in FIGS. 1 and 2, the flow of solder to the second roller 25' is accomplished in the identical manner as described above, as is the collection and removal of solder oxides from underneath the second coating roller 25'.

Figure 4:
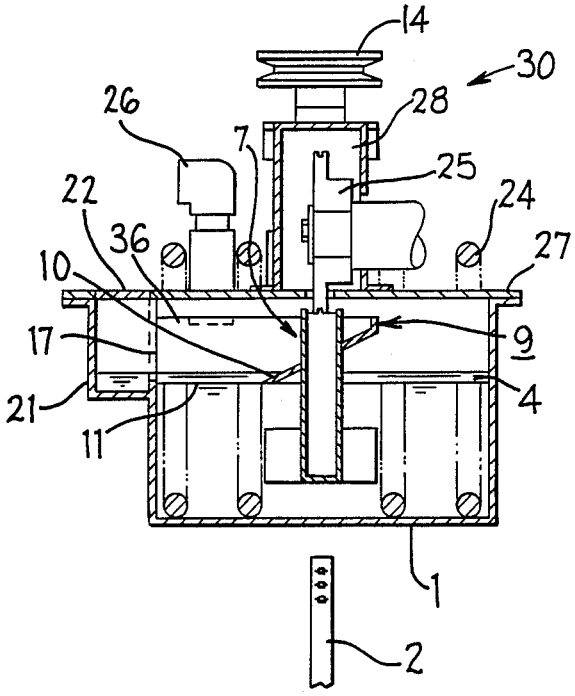
FIG. 4 is a central sectional view, in elevation, of another embodiment of a coating device of the present invention.

Another embodiment of the present invention is illustrated in FIG. 4. In this embodiment, the solder tank 1 is provided with a cover 27 to seal the interior of the tank and an inert gas inlet 26 in order to introduce an inert gas, such as nitrogen, into the interior of the tank 1 to prevent the oxidation of the solder. The solder oxide receiving tank 21 in this embodiment is placed contiguous to the solder oxide outlet 17 and receives the flow therefrom since tank 21 is in continuous communication with the interior of the trough 9. A removable lid 22 is provided on the solder oxide receiving tank 21 and allows entry thereto for the removal of solder oxide.

OPERATION

While the operation of the roller-type solder coating device 30 described above will be apparent to those of ordinary skill in the art, a brief discussion of the operation will be provided for convenience.

Solder is introduced into the tank 1 and put into or maintained at a molten condition by the use of heating coils 24. The solder bath 4 enters a pumping chamber 6 by way of an inlet 5. An impeller 12 is provided in the pumping chamber 6 and driven by a motor 15. The solder contained in the pumping chamber is forced by the impeller 12 to exit the nozzle 7 and contact an outer peripheral surface of the coating roller 25. A workpiece 2 contacts the outer peripheral surface of the coating roller 25 and receives a coating of solder therefrom. Surplus solder not applied to the workpiece 2 falls into the trough 9 which is positioned underneath the coating roller 25 and in sealing engagement with the nozzle 7. The bottom wall 10 of the trough has a downward slope and opens slightly underneath the surface 11 of the solder bath 4. The surplus solder from the nozzle 7 and the roller 25 falls to the trough bottom 10, flows along the trough bottom 10 and into the solder bath 4. Since solder oxide is lighter than solder, the solder oxide floats on the surface of the solder bath contained by the side walls 34 and the bottom wall 10 of the trough 9 and is segregated from the remainder of the solder bath surface. The segregated solder oxide is removed by detaching the cover 19 and allowing the solder oxide to flow through outlets 17 and 18 into the solder oxide receiving tank 21 from where the solder oxide can be conveniently disposed of.

In the embodiment of FIG. 4, the segregated solder oxide automatically flows through outlet 17 and collects within the tank 21 so as to be isolated from the solder within the bath 4.

Roller-type solder coating devices are disclosed in U.S. Pat. No. 4,836,131 and in U.S. Ser. Nos. 07/238,923 and 07/287,904, all owned by the Assignee hereof, so that further detailed description is believed unnecessary.

Although particular preferred embodiments of the invention have been disclosed in detail for illustrative purposes, it will be recognized that variations or modifications of the disclosed apparatus, including the rearrangement of parts, are all within the scope of the present invention.

The embodiments of the invention in which an exclusive property or privilege is claimed are defined as follows:

1. A roller solder coating device comprising tank means for containing a liquid solder bath; a rotatable coating roller for applying a solder coating to a surface of a workpiece, said coating roller being positioned in vertical orientation over said tank means; a pumping chamber contained within said tank means for receiving solder from said bath; nozzle means communicating with said pumping chamber for directing a flow of solder into contact with said coating roller; pump means within said pumping chamber for inducing said flow of solder from the pumping chamber and through the nozzle means; trough means for preventing solder delivered from said nozzle means from directly re-entering said solder bath, said trough means being positioned underneath said coating roller and said nozzle means; a solder oxide outlet disposed at a side of said tank means and partially bounded by said trough means; and a solder oxide receiving tank positioned with respect to said solder oxide outlet so as to be able to receive flow of solder oxide therefrom.

2. The roller solder coating device of claim 1, wherein said tank means is provided with a cover means for isolating the inside of said tank means from the ambient atmosphere, said cover means having an inert gas inlet for introducing an inert gas for preventing the oxidation of the solder within said tank means.

3. The roller solder coating device of claim 1, wherein said trough means is in fluid communication with said solder oxide outlet.

4. The roller solder coating device of claim 1, wherein said solder oxide receiving tank is positioned below said solder oxide outlet and a removable cover is provided on said solder oxide outlet to regulate the flow of solder oxide therefrom.

5. The roller solder coating device of claim 1, wherein said solder oxide outlet is provided in a side of said solder oxide receiving tank and a removable lid is provided on said solder oxide receiving tank to allow the removal of solder oxide therefrom.

6. The roller solder coating device of claim 1, wherein a second rotatable coating roller is positioned in vertical orientation over said tank means and, said coating rollers being positioned adjacent one another so as to simultaneously provide a coating of solder on opposed surfaces of a workpiece passing therebetween.

7. The roller solder coating device of claim 6, including a second pumping chamber, a second nozzle means and a second pumping means for supplying a flow of said solder to said second coating roller.

8. The roller solder coating device of claim 6, wherein a workpiece passageway is provided in said tank means through which said workpiece passes upwardly before it is coated by said coating rollers.

9. A solder coating device comprising tank means for containing a liquid solder bath; a pumping chamber for receiving solder from said bath; nozzle means communicating with said pumping chamber and projecting upwardly above the surface of the bath for discharging an upwardly directed fountain of solder; trough means disposed under the discharge end of said nozzle means for preventing solder delivered from said nozzle means from directly re-entering said solder bath; a solder oxide outlet disposed at a side of said tank means and partially bounded by said trough means for permitting external discharge of solder oxide from said bath.

* * * * *